US007698130B2

(12) United States Patent
Kim et al.

(10) Patent No.: US 7,698,130 B2
(45) Date of Patent: Apr. 13, 2010

(54) AUDIO ENCODING METHOD AND APPARATUS OBTAINING FAST BIT RATE CONTROL USING AN OPTIMUM COMMON SCALEFACTOR

(75) Inventors: Miyoung Kim, Suwon-si (KR); Shihwa Lee, Seoul (KR); Dohyung Kim, Hwaseong-si (KR)

(73) Assignee: Samsung Electronics Co., Ltd., Tokyo (JP)

( * ) Notice: Subject to any disclaimer, the term of this patent is extended or adjusted under 35 U.S.C. 154(b) by 1252 days.

(21) Appl. No.: 11/220,568

(22) Filed: Sep. 8, 2005

(65) Prior Publication Data

US 2006/0053006 A1 Mar. 9, 2006

(30) Foreign Application Priority Data

Sep. 8, 2004 (KR) ..... 10-2004-0071588

(51) Int. Cl.
*G10L 19/00* (2006.01)

(52) U.S. Cl. ..... 704/200.1

(58) Field of Classification Search ..... 704/200.1
See application file for complete search history.

(56) References Cited

U.S. PATENT DOCUMENTS 5,649,053 A * 7/1997 Kim ..... 704/229
6,725,192 B1 * 4/2004 Araki ..... 704/230
6,732,071 B2 * 5/2004 Lopez-Estrada et al. .... 704/219
7,269,554 B2 * 9/2007 Lopez-Estrada et al. .... 704/229
7,409,350 B2 * 8/2008 Hsu ..... 704/501
7,613,603 B2 * 11/2009 Yamashita ..... 704/200.1

FOREIGN PATENT DOCUMENTS

JP 7-202823 8/1995
JP 2004-021092 1/2004

* cited by examiner

*Primary Examiner*—Susan McFaddan
(74) *Attorney, Agent, or Firm*—Staas & Halsey LLP

(57) ABSTRACT

Provided are an audio encoding method and apparatus capable of fast bit rate control. The audio encoding method includes: converting audio sampling data into frequency domain data; adjusting a scalefactor value in each predetermined frequency band based on an available bits and allowed distortion of a psychoacoustic model to allocate a number of necessary bits to the frequency domain data and quantize the frequency domain data; and generating a bit stream based on the quantized data. The quantizing of the frequency domain data includes: obtaining the available bits for the frequency domain data; obtaining the common scalefactor value satisfying that the used bits is not larger than the available bits, using a difference the available bits and the used bits to quantize the audio data; calculating quantization noise in the each predetermined quantization band; and adjusting a scalefactor value of a quantization band in which the quantization noise exceeds the allowed distortion of the psychoacoustic model to quantize the audio data.

8 Claims, 9 Drawing Sheets

AUDIO ENCODING METHOD AND APPARATUS OBTAINING FAST BIT RATE CONTROL USING AN OPTIMUM COMMON SCALEFACTOR

CROSS-REFERENCE TO RELATED APPLICATION

This application claims the benefit of Korean Patent Application No. 10-2004-0071588, filed on Sep. 8, 2004, in the Korean Intellectual Property Office, the disclosure of which is incorporated herein in its entirety by reference.

BACKGROUND OF THE INVENTION

1. Field of the Invention

The present invention relates to audio encoding, and more particularly, to an audio encoding method and apparatus capable of fast bit rate control.

2. Description of the Related Art

FIG. 1 is a block diagram of a conventional audio encoding apparatus. Referring to FIG. 1, the audio encoding apparatus includes a T/F converter 100, a psychoacoustic modeling unit 110, a quantization/bit rate controller 120, a lossless encoder 130, and a bit packing unit 140. The T/F converter 100 converts audio PCM data in the time domain into a signal in the frequency domain. The psychoacoustic modeling unit 110 calculates allowed distortion by reflecting the hearing property of a human. The quantization/bit rate controller 120 quantizes the signal in the frequency domain. Here, the quantization step size of the signal in the frequency domain varies depending on the allowed distortion and the number of bits available. In other words, the quantization/bit rate controller 120 allocates more bits in frequency band in which noise is easily audible due to a low allowed distortion and allocates fewer bits in a frequency band in which the allowed distortion is high. The quantization/bit rate controller 120 performs bit allocation necessary for each frequency band and quantization by adjusting a scalefactor value based on an encoding target bit rate and the allowed distortion of a psychoacoustic model.

FIG. 2 is a block diagram of the quantization/bit rate controller 120 shown in FIG. 1. Referring to FIG. 2, the quantization/bit rate controller 120 includes a distortion controller 200 and a bit rate controller 250.

The distortion controller 200 determines a scalefactor value in each quantization band so as to be suitable for the allowed distortion. The scalefactor value is determined in each scalefactor band and used to quantize frequency domain data in each scalefactor band.

The bit rate controller 250 determines a common scalefactor value used in quantization of the whole frequency band to be suitable for the encoding target bit rate and includes an sf(scalefactor) increase calculator 256, a quantizer 252, and a used bits calculator 254.

The common scalefactor is applied to the whole scalefactor bands and used for quantizing the audio data. Here, the scalefactor value is determined in each scalefactor band starting from the common scalefactor value so as to satisfy the allowed distortion.

The sf increase calculator 256 predicts a final common scalefactor value for the common scalefactor value. The quantizer 252 performs quantization using the calculated common scalefactor value. The used bits calculator 254 calculates the number of bits used for lossless encoding quantized sample data.

FIG. 3 illustrates the operational complexity of each module of the audio encoding apparatus of FIG. 1. As shown in FIG. 3, the complexity of the quantization/bit rate controller 120 occupies more than 50% in the whole audio encoding process and thus it is high. The complexity of the bit rate controller 250 is high due to a repeated loop for searching an optimum common scalefactor value satisfying restrictions of the encoding target bit rate and the allowed distortion.

SUMMARY OF THE INVENTION

Additional aspects and/or advantages of the invention will be set forth in part in the description which follows and, in part, will be apparent from the description, or may be learned by practice of the invention.

The present invention provides an audio encoding method and apparatus capable of fast bit rate control by searching for an optimum common scalefactor fast using an equation derived form from a regression analysis.

According to an aspect of the present invention, there is provided an audio encoding method capable of fast bit rate control, including: converting audio sampling data into frequency domain data; adjusting a scalefactor value in each predetermined frequency band based on an encoding target bit rate and allowed distortion of a psychoacoustic model to allocate a number of necessary bits to the frequency domain data and quantize the frequency domain data; and generating a bit stream based on the quantized data.

In an aspect of a present invention, the quantizing of the frequency domain data for a specific block or frame includes: obtaining the maximum number of bits available as determined by encoding target bit rate for the frequency domain data; obtaining the common scalefactor value satisfying that the number of bits used is not more than the number of bits available, using a difference the encoding target bits and the used bits to quantize the audio data; calculating quantization noise in the each predetermined quantization band; and adjusting a scalefactor value of a quantization band in which the quantization noise exceeds the allowed distortion of the psychoacoustic model to quantize the audio data.

The obtaining of the common scalefactor value satisfying that the used bits is not larger than the encoding target bits, using the difference of the encoding target bits and the used bits to quantize the audio data, may include: setting an initial value of the common scalefactor value; quantizing the audio data using the common scalefactor value; calculating the used bits; comparing the encoding target bits and the used bits, and if the encoding target bits is lower than the used bits, increasing the common scalefactor value by a value determined from the difference between the encoding target bits and the used bits; and quantizing the audio data using the increased common scalefactor value to calculate the used bits.

The value may be determined as follows:

$$\Delta sf=\alpha+\beta(\text{available bits}-\text{used bits})+\gamma(\text{current common_scalefactor})$$

wherein $\alpha$, $\beta$, and $\gamma$ are constants.

According to another aspect of the present invention, there is provided an audio encoding apparatus capable of fast bit rate control, including: a T/F converter converting audio sampling data into frequency domain data; a bit number allocator/quantizer adjusting a scalefactor value in each predetermined frequency band based on an encoding target bits and allowed distortion of a psychoacoustic model to allocate a number of necessary bits to the frequency domain data and quantize the frequency domain data; a bit stream generator generating a bit stream based on the quantized data. The bit number allocator/ quantizer includes: a target bit rate calculator calculating the encoding target bit rate of the frequency domain data; a full band quantizer obtaining the common scalefactor value commonly used in a whole frequency band and satisfying that the used bits is not more than the encoding target bits to quantize the audio data; a noise calculator calculating quantization noise in each quantization band; and a each band quantizer adjusting a scalefactor value of a quantization band in which the quantization noise exceeds the allowed distortion of the psychoacoustic model to quantize the audio data.

The full band quantizer may include: an initial value setter setting an initial value of the common scalefactor value; a first quantizer quantizing the audio data using the common scalefactor value; a used bit rate calculator receiving the quantized audio data to calculate the used bit rate; a common scalefactor value increaser comparing the encoding target bit rate and the used bit rate, and if the encoding target bit rate is lower than the used bit rate, increasing the common scalefactor value by a value determined from a difference between the encoding target bit rate and the used bit rate; and a second quantizer quantizing the audio data using the increased common scalefactor value and outputting the quantized audio data to the used bit rate calculator.

According to another aspect of the present invention, there is provided a audio encoding method, including: converting audio sampling data into frequency domain data; adjusting a scalefactor value using a common scale factor value used in whole band; quantizing the frequency domain data; and generating a bit stream based on the quantized data; wherein the common scalefactor value using a equation derived from a regression analysis.

According to still another aspect of the present invention, there is provided a computer-readable recording medium having embodied thereon a computer program for executing the audio encoding method.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
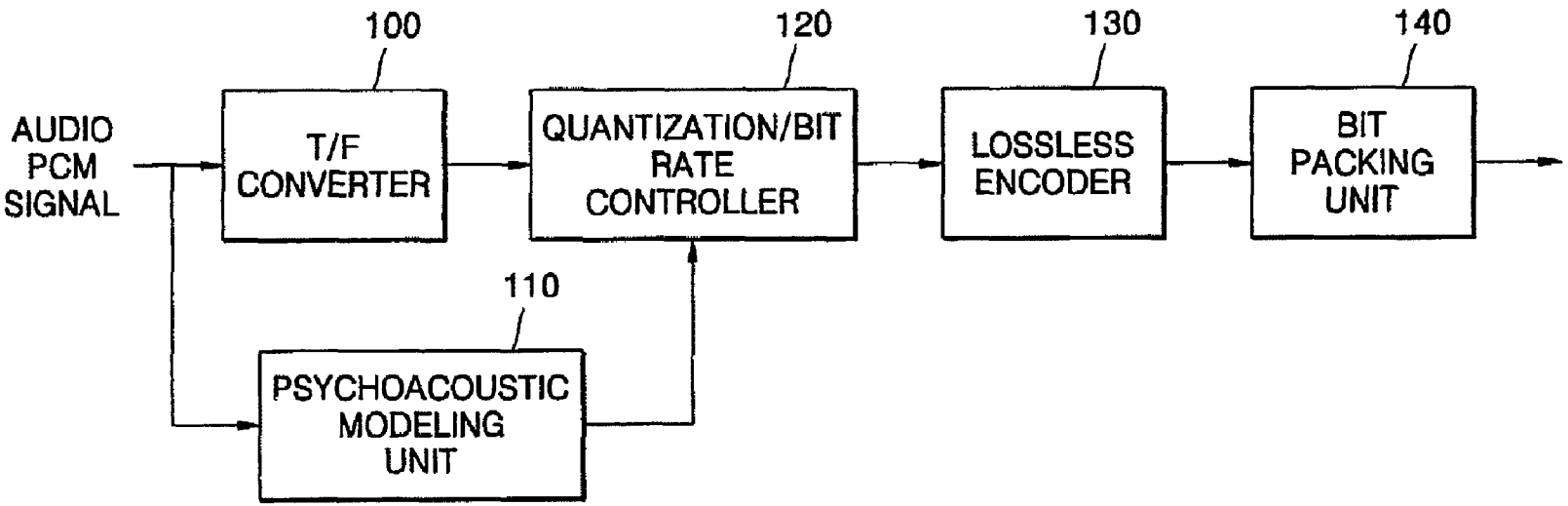
FIG. 1 (PRIOR ART)
FIG. 1 is a block diagram of a conventional audio encoding apparatus.
Figure 2:
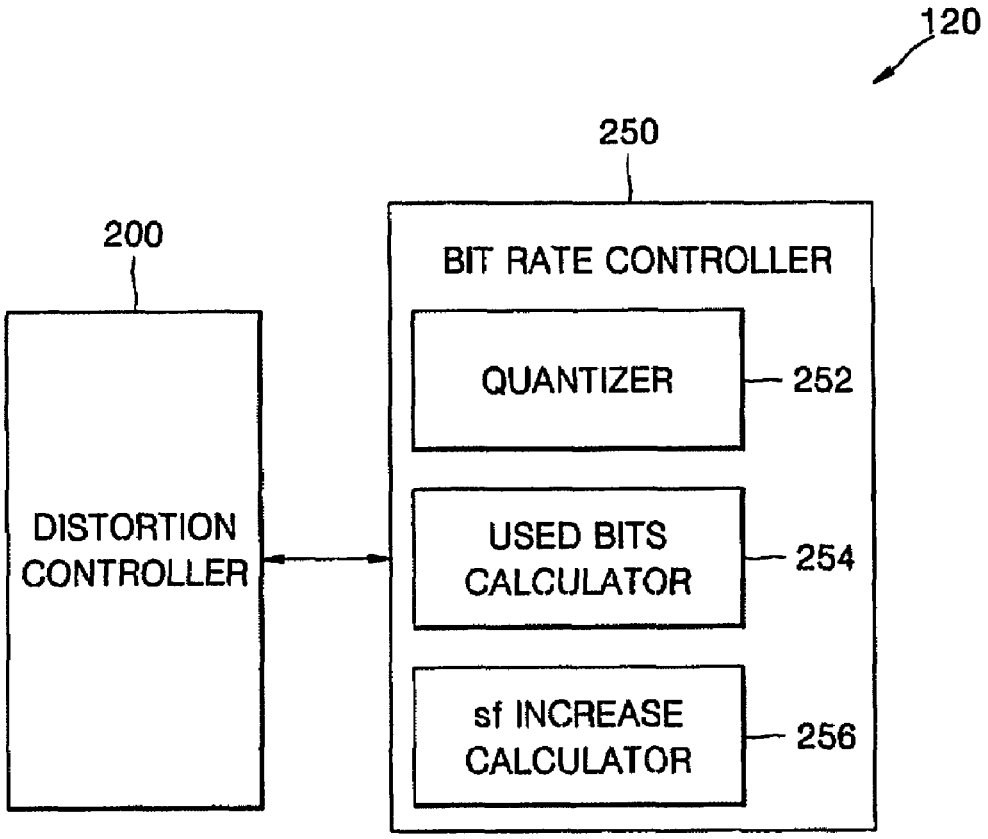
FIG. 2 (PRIOR ART)
FIG. 2 is a block diagram of a quantization/bit rate controller shown in FIG. 1.
Figure 3:
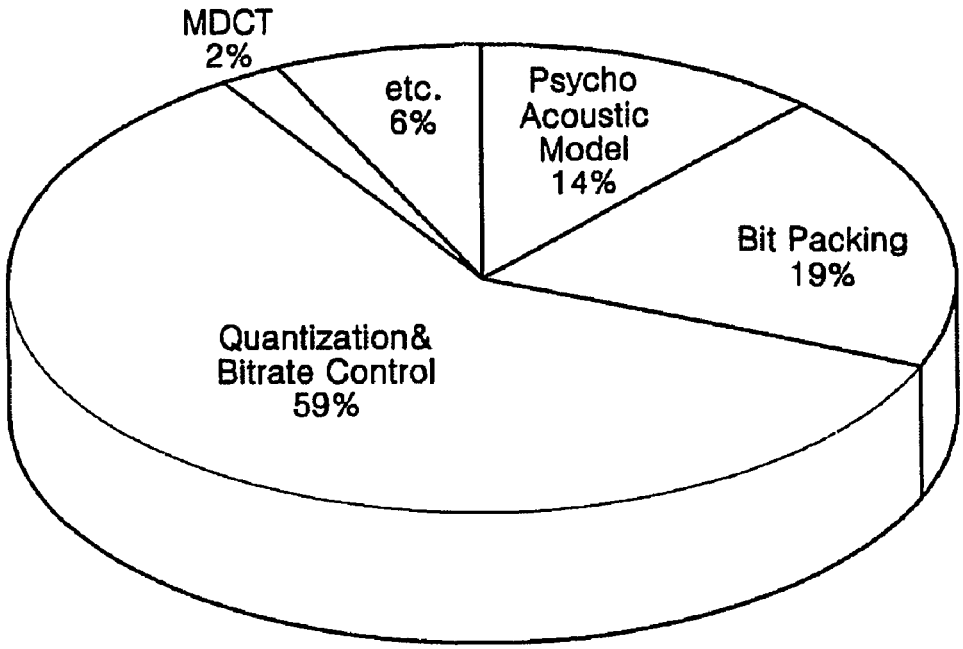
FIG. 3 illustrates the operational complexity of each module of the audio encoding apparatus.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, an audio encoding method and apparatus according to the present invention will be described in detail with reference to the attached drawings.

Figure 4:
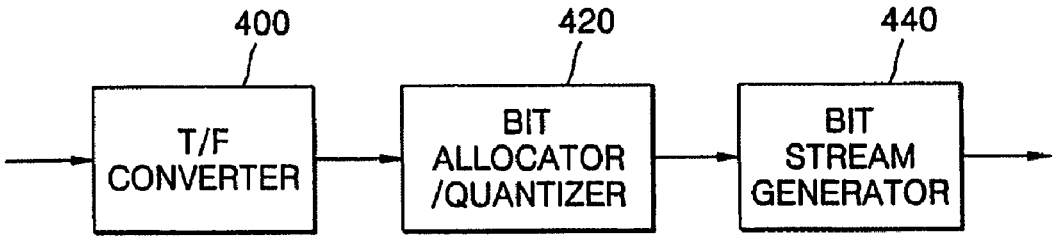
FIG. 4 is a block diagram of an audio encoding apparatus according to an embodiment of the present invention.

FIG. 4 is a block diagram of an audio encoding apparatus according to an embodiment of the present invention. The audio encoding apparatus includes a T/F converter 400, a bit allocator/quantizer 420, and a bit stream generator 440.

The T/F converter 400 converts audio sampling data in a time domain into audio data in a frequency domain. The bit allocator/quantizer 420 allocates a number of bits to the audio data in the frequency domain and quantizes the audio data by adjusting a scalefactor value in each predetermined band based on an encoding available bits and allowed distortion of a psychoacoustic model. The bit stream generator 440 generates a bit stream based on the quantized data.

Figure 5:
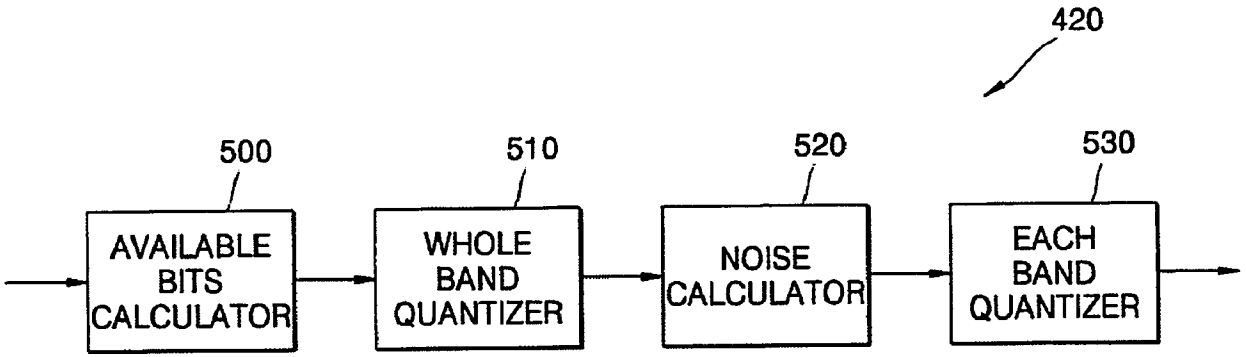
FIG. 5 is a block diagram of a bit allocator/quantizer shown in FIG. 4.

FIG. 5 is a block diagram of the bit allocator/quantizer 420 shown in FIG. 4. The bit allocator/quantizer 420 includes an available bits calculator 500, a whole band quantizer 510, a noise calculator 520, and an each band quantizer 530. The available bits calculator 500 calculates the available bits for the audio data in the frequency domain. The whole band quantizer 510 obtains a common scalefactor value used in the whole frequency band satisfying that a used bits is not larger than the available bits to quantize the audio data. The noise calculator 520 calculates quantization noise in each quantization band. The each band quantizer 530 adjusts a scalefactor value of a quantization band in which the quantization noise exceeds the allowed distortion obtained from the psychoacoustic model and quantizes the audio data in each band using the adjusted scalefactor value.

Figure 6:
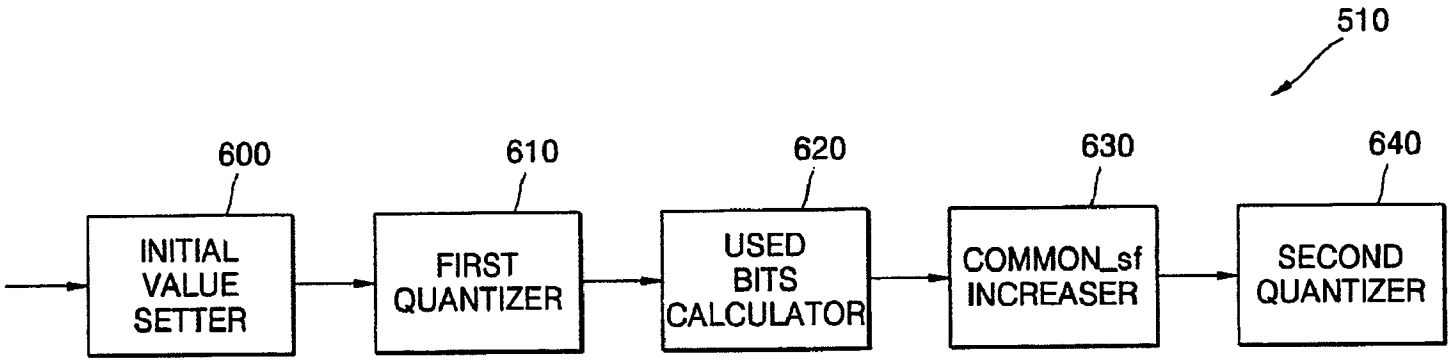
FIG. 6 is a block diagram of a whole band quantizer shown in FIG. 5.

FIG. 6 is a block diagram of the whole band quantizer 510 shown in FIG. 5. Referring to FIG. 6, the whole band quantizer 510 includes an initial value setter 600, a first quantizer 610, a used bits calculator 620, a common scalefactor increaser 630, and a second quantizer 640.

The initial value setter 600 sets an initial value of the common scalefactor value commonly used in the full band of the audio data in the frequency domain.

The first quantizer 610 quantizes the audio data using the common scalefactor value. The used bits calculator 620 receives the quantized audio data to calculate the used bits. The full band scalefactor increaser 630 compares the available bits with the used bits, and if the available bits are less than the used bits, increases the common scalefactor value by a value determined from a difference between the available bits and the used bits. The value may be determined as in Equation 1:

$$\Delta sf=\alpha+\beta(\text{available bits}-\text{used bits})+\gamma(\text{current common_scalefactor}) \quad (1)$$

wherein $\alpha$, $\beta$, and $\gamma$ are constants.

When the common scalefactor value is increased, the second quantizer 640 quantizes the audio data using the increased common scalefactor value and outputs the quantized audio data to the used bits calculator 620.

Figure 7:
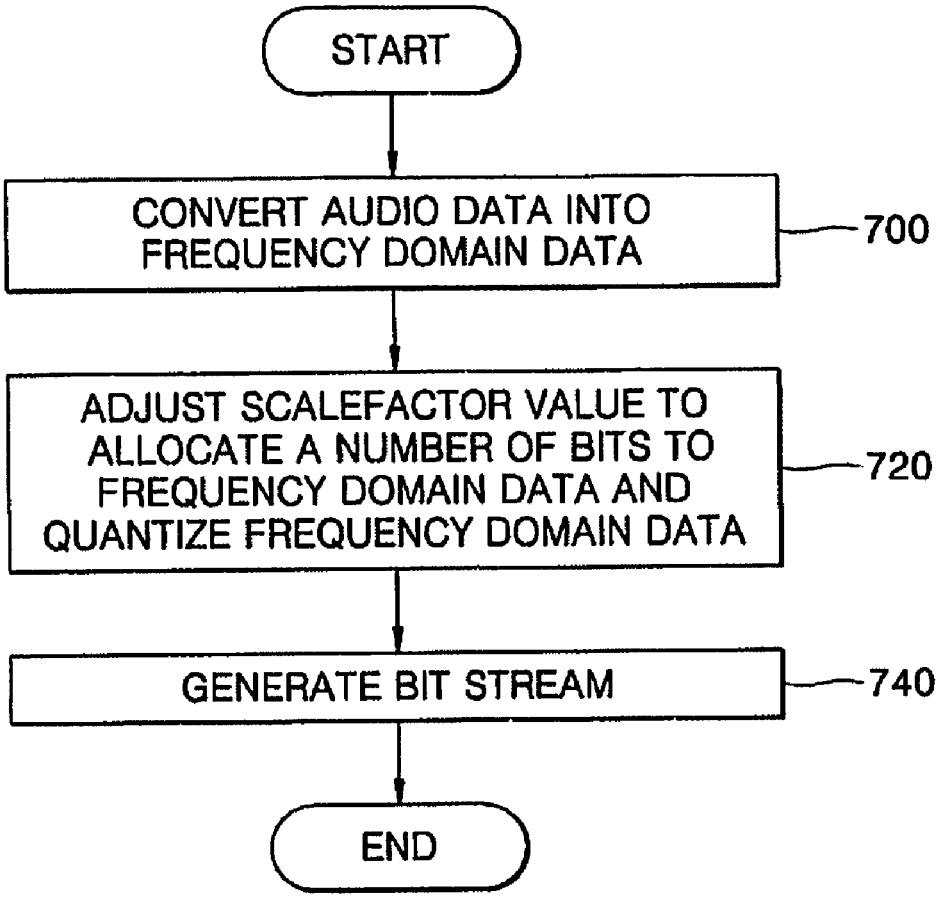
FIG. 7 is a flowchart of an audio encoding method according to an embodiment of the present invention.

FIG. 7 is a flowchart of an audio encoding method according to an embodiment of the present invention. Referring to FIG. 7, in operation 700, audio data in a time domain is converted into audio data in a frequency domain. In operation 720, a scalefactor value is adjusted in each predetermined frequency band based on an available bits and allowed distortion of a psychoacoustic model to allocate a number of bits to the audio data in the frequency domain and quantizes the data.

In operation 740, a bit stream is generated based on the quantized data. In general, before the bit stream is generated, the quantized data may be lossless encoded.

Figure 8:
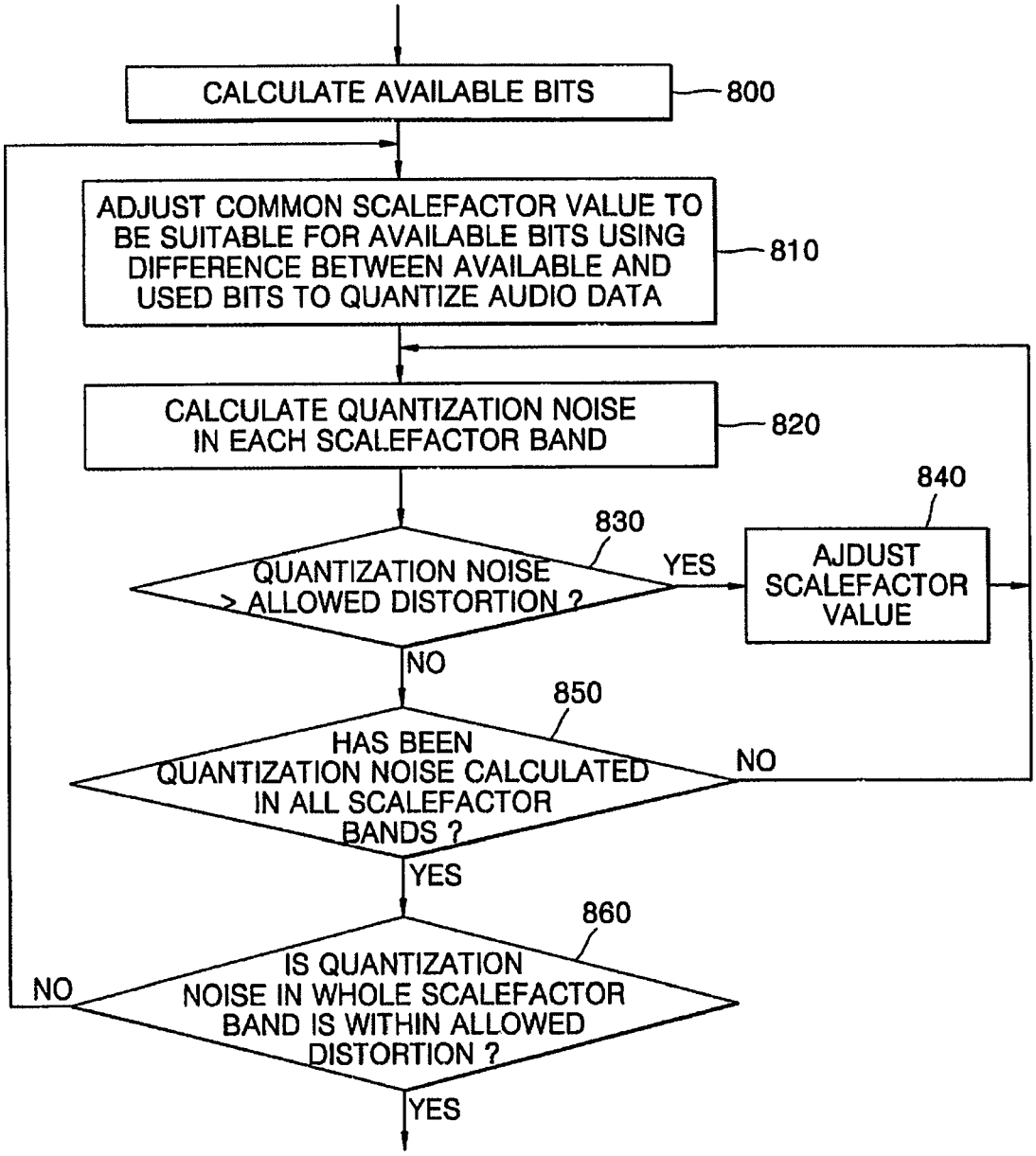
FIG. 8 is a flowchart of operation 720 of the audio encoding method of FIG. 7.

FIG. 8 is a flowchart of operation 720 of the audio encoding method of FIG. 7. Referring to FIG. 8, in operation 800, the available bits are calculated for the specific audio block or frame. In operation 810, a common scalefactor value commonly used in the whole band is adjusted to be suitable for the available bits using a difference between the available bits and a used bits to quantize the audio data in the frequency domain. In operation 820, quantization noise is calculated in each scalefactor band using the quantization data. In operation 830, a determination is made as to whether the quantization noise exceeds the allowed distortion of the psychoacoustic model. If it is determined in operation 830 that the quantization noise has exceeded the allowed distortion, in operation 840, the scalefactor is adjusted in each band to quantize the audio data, and then the process returns to operation 820 to calculate quantization noise in a corresponding scalefactor band using the adjusted scalefactor value.

If it is determined in operation 830 that the quantization noise is within the allowed distortion, in operation 850, a determination is made as to whether quantization noise has been calculated in all scalefactor bands. If it is determined in operation 850 that the quantization noise has not been calculated in all scalefactor bands, the process returns to operation 820 to calculate quantization noise in each scalefactor band. If it is determined in operation 850 that the quantization noise has been calculated in all scalefactor bands, in operation 860, a determination is made as to whether quantization noise in the whole scalefactor band is within the allowed distortion. If it is determined in operation 860 that the quantization noise in the whole scalefactor band is not within the allowed distortion, the process returns to operation 810 to adjust the common scalefactor value.

If it is determined in operation 860 that the quantization noise in the whole scalefactor band is within the allowed distortion, next operation is performed to encode the audio data.

Figure 9:
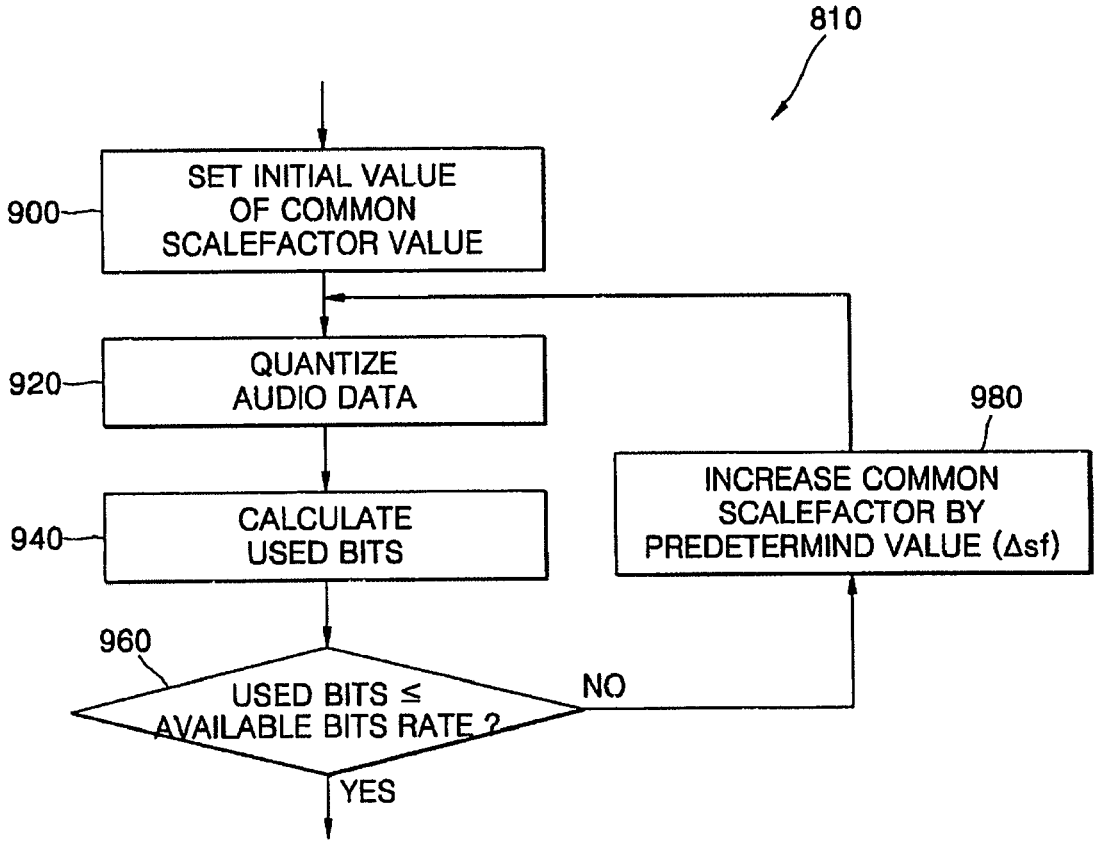
FIG. 9 is a flowchart of operation 810 of FIG. 8.

FIG. 9 is a flowchart of operation 810 of FIG. 8. In operation 900, an initial value of the common scalefactor value is set. In operation 920, quantization is performed using the set initial value. In operation 940, the used bits are calculated. In operation 960, the used bits are compared with the available bits. If the available bits is less than the used bits in operation 960, in operation 980, the common scalefactor value is increased by a value Δsf, and then the process returns to operation 920 to perform operations 980, 920, and 940 until the used bits is less than the available bits. In other words, if the used bits exceed the available bits, a quantization step size is increased to repeat a bit rate control process until the used bits is less than the available bits.

As described with reference to FIG. 9, the common scalefactor value can be increased one by one so as to elaborately search an optimum common scalefactor value in a bit rate control loop. However, complexity is increased. A final common scalefactor value can be fast searched by predicting an optimum common scalefactor increase value Δsf without increasing the common scalefactor one by one and repeating the bit rate control loop.

Table 1 below shows correlations between a common scalefactor and an amount of bits difference (used bits−available bits) in each loop process of the bit rate control loop. Here, the common scalefactor value and the bit rate difference have predetermined correlations, and thus the optimum common scalefactor increase value Δsf having the bit rate difference of "0" can be determined using the predetermined correlations.

TABLE 1

| | C5 | C1 | C2 | C3 |
|---|---|---|---|---|
| C1 | 0.957 | | | |
| C2 | 0.088 | 0.267 | | |
| C3 | 0.972 | 0.988 | 0.115 | |
| C4 | −0.438 | −0.47 | 0.006 | −0.485 |

In Table 1, C1 denotes the used bits, C2 denotes the available bits, C3=C1−C2, C4 denotes a current common scalefactor value, and C5=final common scalefactor value−current common scalefactor value. C5 denotes a common scalefactor value increase for reaching a final common scalefactor value.

Figure 10:
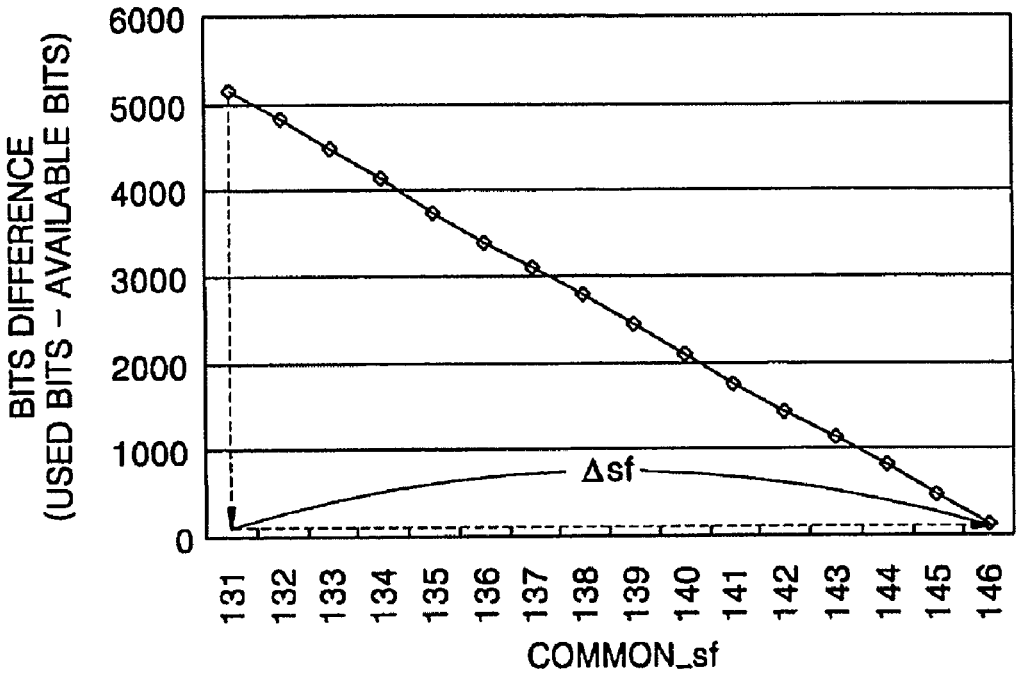
FIG. 10 is a graph illustrating an analysis of correlations between parameters related to quantization/bit rate control.

As shown in FIG. 10, the correlation between the common scalefactor value and the bit rate difference is 0.972 and thus high.

The common scalefactor value increase Δsf of the final common scalefactor value for an initial common scalefactor value is determined using Equation 1 above. Here, constants α, β, and γ can be precisely determined to be close to the final common scalefactor value using a value determined from a regression analysis. The regression analysis is a statistic analysis method in which a mathematical (statistic) model is supposed to clarify a functional correlation between parameters and the mathematical model is predicted using observed data. The regression analysis is mainly used for prediction. In the statistical analysis method, a result parameter of the parameters is determined as a dependent parameter to clarify an influence power of independent parameters on the dependent parameter, correlations between the dependent parameter and the independent parameters, and the like.

Figure 11:
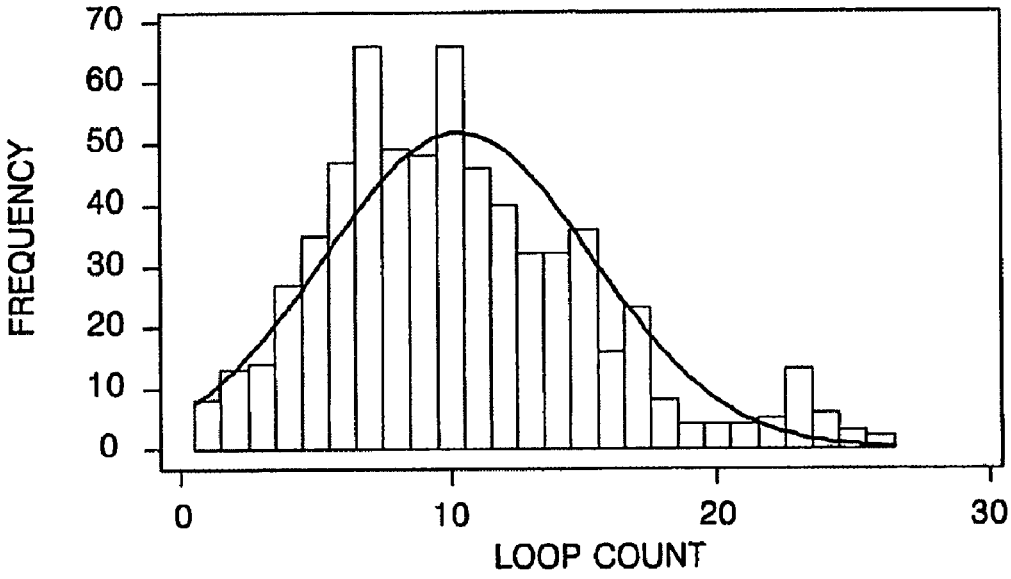
FIG. 11 is a graph illustrating how many times a loop shown in FIG. 9 is performed before the present invention is applied.
Figure 12:
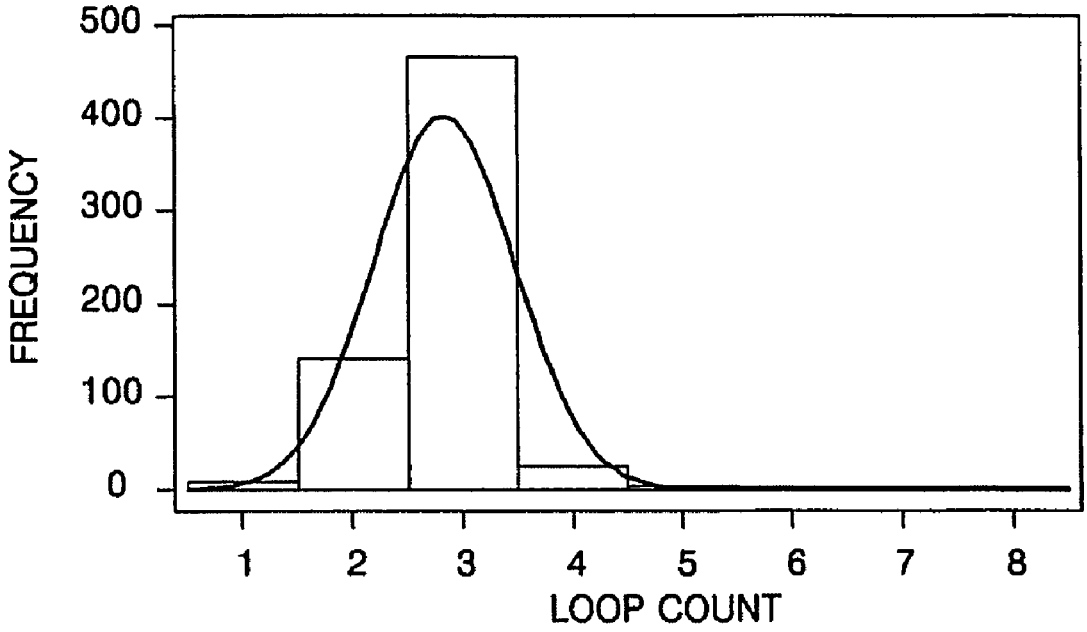
FIG. 12 is a graph illustrating how many times of the loop shown in FIG. 9 is performed after the present invention is applied.

FIG. 11 is a graph illustrating how many times a bit rate control loop shown in FIG. 9 is performed before the audio encoding method of the present invention is applied. FIG. 12 is a graph illustrating how many times the bit rate control loop is performed after the audio encoding method of the present invention is applied. Before the audio encoding method of the present invention is applied, the bit rate control loop is performed 10 or more times. After an algorithm of the present invention is applied, the bit rate control loop is performed 2 or 3 times on average. After the audio encoding method of the present invention is applied, a measurement result of a whole audio encoding time is decreased from 2 or 3 times to 4.9 times.

As described above, in an audio encoding method and apparatus capable of fast bit rate control, an optimum common scalefactor value can be fast searched using equation deriving from a regression analysis. Thus, bit rate control can be fast performed.

The invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and the like.

Although a few embodiment of the present invention have been shown and described, it would be appreciated by those skilled in the art that changes may be made in these exemplary embodiments without departing from the principles and spirit of the invention, the scope of which is defined in the claims and their equivalents.

What is claimed is:

1. An audio encoding method capable of fast bit rate control and being executed by a processor, the method, comprising:

converting audio sampling data into frequency domain data by using the processor;

adjusting a scalefactor value in each predetermined frequency band based on an available bits and allowed distortion of a psychoacoustic model to allocate a number of necessary bits to the frequency domain data by using the processor;

quantizing the frequency domain data by using the processor; and generating a bit stream based on the quantized data by using the processor, wherein quantizing the frequency domain data comprises:

obtaining available bits for the frequency domain data;

obtaining the common scalefactor value satisfying that the number of used bits is not larger than the number of available bits, using a difference of the available bits and the used bits to quantize the audio data;

calculating quantization noise in each predetermined quantization band; and adjusting a scalefactor value of a quantization band in which the quantization noise exceeds the allowed distortion of the psychoacoustic model to quantize the audio data.

2. The audio encoding method of claim 1, wherein the obtaining of the common scalefactor value satisfying that the used bits is not larger than the available bits rate, using the difference the available bits and the used bits to quantize the audio data, comprises:

setting an initial value of the common scalefactor value;

first quantizing the audio data using the common scalefactor value;

calculating the used bits;

comparing the available bits with the used bits, and if the available bits is less than the used bits, increasing the common scalefactor value by a value determined from the difference between the available bits and the used bits; and second quantizing the audio data using the increased common scalefactor value to calculate the used bit rate.

3. The audio encoding method of claim 2, wherein the value is determined as follows:

$$\Delta sf=\alpha+\beta(\text{available bits}-\text{used bits})+\gamma(\text{current common_scalefactor})$$

wherein α, β, and γ are constants.

4. An audio encoding apparatus having fast bit rate control, comprising:

a Time/Frequency (T/F) converter converting audio sampling data into frequency domain data;

a bit allocator/quantizer adjusting a scalefactor value in each predetermined frequency band based on an available bits and allowed distortion of a psychoacoustic model to allocate a number of necessary bits to the frequency domain data and quantize the frequency domain data; and a bit stream generator generating a bit stream based on the quantized data wherein the bit allocator/quantizer comprises:

an available bits calculator calculating available bits of the frequency domain data;

a whole band quantizer obtaining the common scalefactor value commonly used in a whole frequency band using a difference of the available bits and the used bits and satisfying that the number of used bits is not larger than the number of available bits to quantize the audio data;

a noise calculator calculating quantization noise in each quantization band; and an each band quantizer adjusting a scalefactor value of a quantization band in which the quantization noise exceeds the allowed distortion of the psychoacoustic model to quantize the audio data.

5. The audio encoding apparatus of claim 4, wherein the whole band quantizer comprises:

an initial value setter setting an initial value of the common scalefactor value;

a first quantizer quantizing the audio data using the common scalefactor value;

a used bits calculator receiving the quantized audio data to calculate the used bits;

a common scalefactor value increaser comparing the available bits and the used bits, and if the available bits is less than the used bits, increasing the common scalefactor value by a value determined from a difference between the encoding available bits and the used bits; and a second quantizer quantizing the audio data using the increased common scalefactor value and outputting the quantized audio data to the used bit rate calculator.

6. The audio encoding apparatus of claim 5, wherein the value is determined as follows:

$$\Delta sf=\alpha+\beta(\text{available bits}-\text{used bits})+\gamma(\text{current common_scalefactor})$$

wherein α, β, and γ are constants.

7. A computer-readable recording medium having embodied thereon a computer program for executing the audio encoding method of claim 1.

8. An audio encoding method having fast bit rate control and being executed by a processor, the method, comprising:

converting audio sampling data into frequency domain data by using the processor;

adjusting a scalefactor value using a common scale factor value used in whole band by using the processor;

quantizing the frequency domain data by using the processor; and generating a bit stream based on the quantized data by using the processor;

wherein the common scalefactor value using an equation derived from a regression analysis is adjusted using a different between the number of available bits and the number of used bits.

* * * * *